US005953551A

United States Patent [19]

Tanaka

[11] Patent Number: 5,953,551

[45] Date of Patent: Sep. 14, 1999

[54] DENTAL X-RAY FILM DEVELOPING MACHINE

[75] Inventor: Hiroyuki Tanaka, Yokohama, Japan

[73] Assignee: NIX Company Ltd., Tokyo, Japan

[21] Appl. No.: 09/068,411

[22] PCT Filed: Sep. 5, 1997

[86] PCT No.: PCT/JP97/03121

§ 371 Date: May 6, 1998

§ 102(e) Date: May 6, 1998

[87] PCT Pub. No.: WO98/10332

PCT Pub. Date: Mar. 12, 1998

[30] Foreign Application Priority Data

Sep. 6, 1996 [JP] Japan ..... 8-271250

[51] Int. Cl.[6] ..... G03D 13/04

[52] U.S. Cl. ..... 396/636

[58] Field of Search ..... 396/578, 632, 396/636, 641

[56] References Cited

U.S. PATENT DOCUMENTS 5,790,914 8/1998 Gates et al. ..... 396/578

FOREIGN PATENT DOCUMENTS

| | | |
|---|---|---|
| 56-20538 | 5/1981 | Japan . |
| 59-165061 | 9/1984 | Japan . |
| 60-20115 | 6/1985 | Japan . |
| 2-128149 | 10/1990 | Japan . |
| 3-9352 | 1/1991 | Japan . |
| 8-220723 | 8/1996 | Japan . |

*Primary Examiner*—D. Rutledge

*Attorney, Agent, or Firm*—Evenson, McKeown, Edwards & Lenahan, PLLC

[57] ABSTRACT

A developing processor is constructed of a chassis block 300 with a developer reservoir, a fixer reservoir and a washing solution reservoir arranged on a chassis, a base plate block 200 detachably mounted on the chassis block 300, and a roller block 100 detachably mounted on the base plate block 200. The roller block 100 is constructed of roller pairs which form processing spaces for development, fixing and washing, respectively. Parts, each of which is likely to develop a trouble or is not very likely to develop a trouble, are all fixed on a base plate 201 of the base block 200. Included as these parts are a control box 210, a drive motor for driving the rollers, a warm-air fan 213, a pump motor, and the like. Upon development of a trouble, the base plate block 200 is replaced.

17 Claims, 5 Drawing Sheets

DENTAL X-RAY FILM DEVELOPING MACHINE

TECHNICAL FIELD

This invention relates to a dental X-ray film developing processor for developing dental films which have already been exposed to X-rays.

BACKGROUND ART

X-ray photography is used for the treatment or diagnosis of teeth. This X-ray photography is conducted by sealing an X-ray film in an exposure-preventing pack and then exposing the film to X-rays with the pack maintained in contact with a target tooth of the photography. After completion of the photography, the pack is taken out of the mouth and the X-ray film is then developed by a dental X-ray film developing processor. Such dental X-ray film developing processors include various types, but developing processors of the type disclosed in Japanese Utility Model Publication (Kokoku) No. SHO 60-20115 are superior for their permitting development of an X-ray film in a planar form.

According to the developing processor disclosed in the above publication, two pairs of rollers, each pair being composed of two rollers maintained in close contact with each other, are spacedly arranged between two side walls which oppose each other, a bottom wall is arranged between the side walls and below the roller pairs so that a processing space is formed by the two roller pairs, the respective side walls and the bottom wall. A processing solution for an X-ray film is filled in the processing space and the individual rollers are rotated, whereby the X-ray film is caused to move through the processing solution from one of the roller pairs to the other roller pairs. In the course of this movement, processing of the X-ray film is performed. The processing solution is sucked up from a reservoir in which the processing solution is stored, and is then filled in the processing space. An overflow is formed through the side wall of the processing space and, when the filled processing solution rises beyond the overflow, the processing solution is discharged out of the processing space through the overflow and is returned to the reservoir.

A dental X-ray film developing processor in which processing spaces of the above-described type are arranged for development processing, fixing processing and washing processing, respectively, is disclosed in Japanese Utility Model Application No. HEI 1-35608. This dental X-ray film developing processor is divided into an upper main body and a lower main body, the upper main body is provided only with rollers which form the above-described processing spaces, and elements other than the rollers are mounted on the lower main body. The dental X-ray film developing processor is assembled by mounting the upper main body on the lower main body. The division of a dental X-ray film developing processor into an upper main body and a lower main body as described above permits easy and thorough cleaning of rollers and the like.

Incidentally, many of users of dental X-ray film developing processors are general dental practitioners, who are specialized in the treatment and diagnosis of teeth, and their employees. These people are not accustomed to the operation of such dental X-ray film developing processors and, practically, cannot afford to fully read instruction manuals. When a dental X-ray film developing processor is operated by such a non-expert, a trouble may often occur by a human error or the like which is unpredictable by its designer, manufacturer or seller. The occurrence of the trouble is usually reported to a distributor or the manufacturer via the seller. The seller or manufacturer gathers necessary parts from the reported details of the trouble and then sends a serviceman with the parts to repair the trouble.

However, servicemen are not always ready for immediate service visits but, under the current circumstances, are usually very busy repairing troubles. It therefore takes a substantial time until a serviceman can be dispatched. Even when a serviceman is sent, his finding of a need for a part other than those carried with him makes it necessary for him to revisit the same user by carrying the additional part, resulting in the need for a further time until the trouble is repaired. If the trouble is extensive and cannot be fixed by a limited repair, he has to carry back the broken developing processor and, subsequent to its repair by the seller or manufacturer, has to deliver it back to the user. For these reasons, it generally takes from a week in a fast case to several weeks in a tardy case until the occurrence of a trouble until the completion of its repair. During this period, the user cannot use the dental X-ray film developing processor, thereby inconveniencing treatments and diagnoses. A still longer time is required for a repair especially when a trouble occurs at a place remote from the seller or manufacturer.

An object of the present invention is to solve the above-described problems of the prior art, and hence to provide a dental X-ray film developing processor which permits promptly coping with any trouble.

DISCLOSURE OF THE INVENTION

It has come to the mind of the present inventor that the above-described object can be achieved by assembling parts, each of which is considered to involve a potential problem of developing a trouble, in a single block, constructing the block detachably relative to a dental X-ray film developing processor and, in the event of occurrence of a trouble, replacing the block, which contains a broken part, with a block in which the corresponding part is in order.

According to the present invention, there are arranged a roller block composed of plural rollers for permitting development of a dental X-ray film, a base plate block, and a chassis block with a built-in reservoir containing a processing solution for the development. The base plate block is provided at least with a roller drive mechanism for driving the rollers and a processing solution feeding device for feeding the processing solution from the reservoir to the roller block, whereby the roller block, the base plate block and the chassis block are detachable independently.

Further, the present invention provides a dental X-ray film developing processor provided with at least two sets of roller pairs, each set including two roller pairs arranged at an interval therebetween and composed individually of mutually-contacting two rollers disposed in an up-and-down relationship, thereby permitting development of a dental X-ray film between the roller pairs in a first set and fixing of the dental X-ray film between the roller pairs in a second set, comprising: an integrally-constructed roller block with the individual rollers assembled therein; an integrally-constructed base plate block having a base plate, two roller spaces continuously formed on an upper side of the base plate and accommodating the rollers therein to construct a developer filling space and a fixer filling space in combination with the rollers, a roller drive mechanism for driving the individual rollers, processing solution filling devices for filling corresponding processing solutions from a developer reservoir and a fixer reservoir into the developer filling space and the fixer filling space, a control box provided with operation devices for the developing processor, and an electric element assembly collectively storing therein electric elements of a drive circuit for the dental X-ray film developing processor, said roller drive mechanism, said processing solution filling devices, said control box and said electric element assembly being all fixed on a lower side of the base plate; and a chassis block with at least the developer reservoir and the fixer reservoir assembled therein; whereby the roller block, the base plate block and the chassis block are detachable independently.

The base plate block may have heaters and solution temperature sensors fixed thereon so that said heaters and said solution temperature sensors can be positioned in said developer reservoir and said fixer reservoir, respectively.

The base plate block may have at least one of float switches positioned in the developer reservoir and the fixer reservoir to detect solution levels therein, an earth leakage breaker for cutting off a power supply upon detection of an electric leakage, and a limiter switch for closing a power supply circuit when the roller block has been mounted on the base plate block.

The present invention also provides a dental X-ray film developing processor provided with four sets of roller pairs, each set including two roller pairs arranged at an interval therebetween and composed individually of mutually-contacting two rollers disposed in an up-and-down relationship, thereby permitting development of a dental X-ray film between the roller pairs in a first set, fixing of the dental X-ray film between the roller pairs in a second set, washing of the dental X-ray film between the roller pairs in a third set and drying of the dental X-ray film between the roller pairs in a fourth set, comprising: an integrally-constructed roller block with the individual rollers assembled therein; an integrally-constructed base plate block having a base plate, four roller spaces continuously formed on an upper side of the base plate and accommodating the rollers therein to construct a developer filling space, a fixer filling space, a washing solution filling space and a drying space in combination with the rollers, a roller drive mechanism for driving the individual rollers, processing solution filling devices for filling corresponding processing solutions from a developer reservoir, a fixer reservoir and a washing solution reservoir into the developer filling space, the fixer filling space and the washing solution filling space, a control box provided with operation devices for the developing processor, and an electric element assembly collectively storing therein electric elements of a drive circuit for the dental X-ray film developing processor, heaters, solution temperature sensors and solution-level-detecting float switches positioned in the developer reservoir and the fixer reservoir, an earth leakage breaker for cutting off a power supply upon detection of an electric leakage, a limiter switch for closing a power supply circuit when the roller block has been mounted on the base plate block, and a warm-air fan for blowing warm air into the drying space, said roller drive mechanism, said processing solution filling devices, said control box, said electric element assembly, said heaters, said solution temperature sensors, said float switches, said earth leakage breaker, said limiter switch and said warm-air fan being all fixed on a lower side of said base plate; and a chassis block with the developer reservoir, the fixer reservoir and the washing solution reservoir assembled therein; whereby the roller block, the base plate block and the chassis block are detachable independently.

BEST MODE FOR CARRYING OUT THE INVENTION

Figure 1:
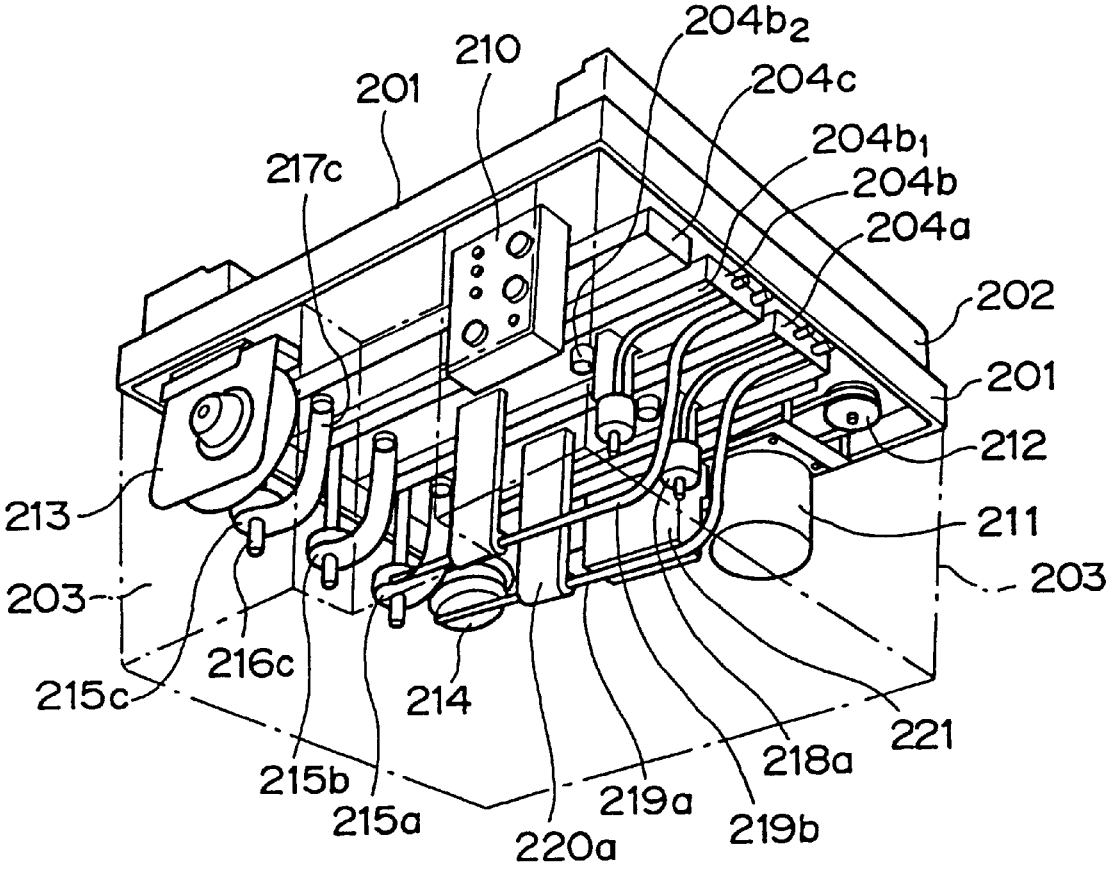
FIG. 1 is a perspective view of a lower side of a base plate block of a dental X-ray film developing processor according to an embodiment of the present invention.

The present invention will hereinafter be described based on the embodiment illustrated in the drawings.

Figure 2:
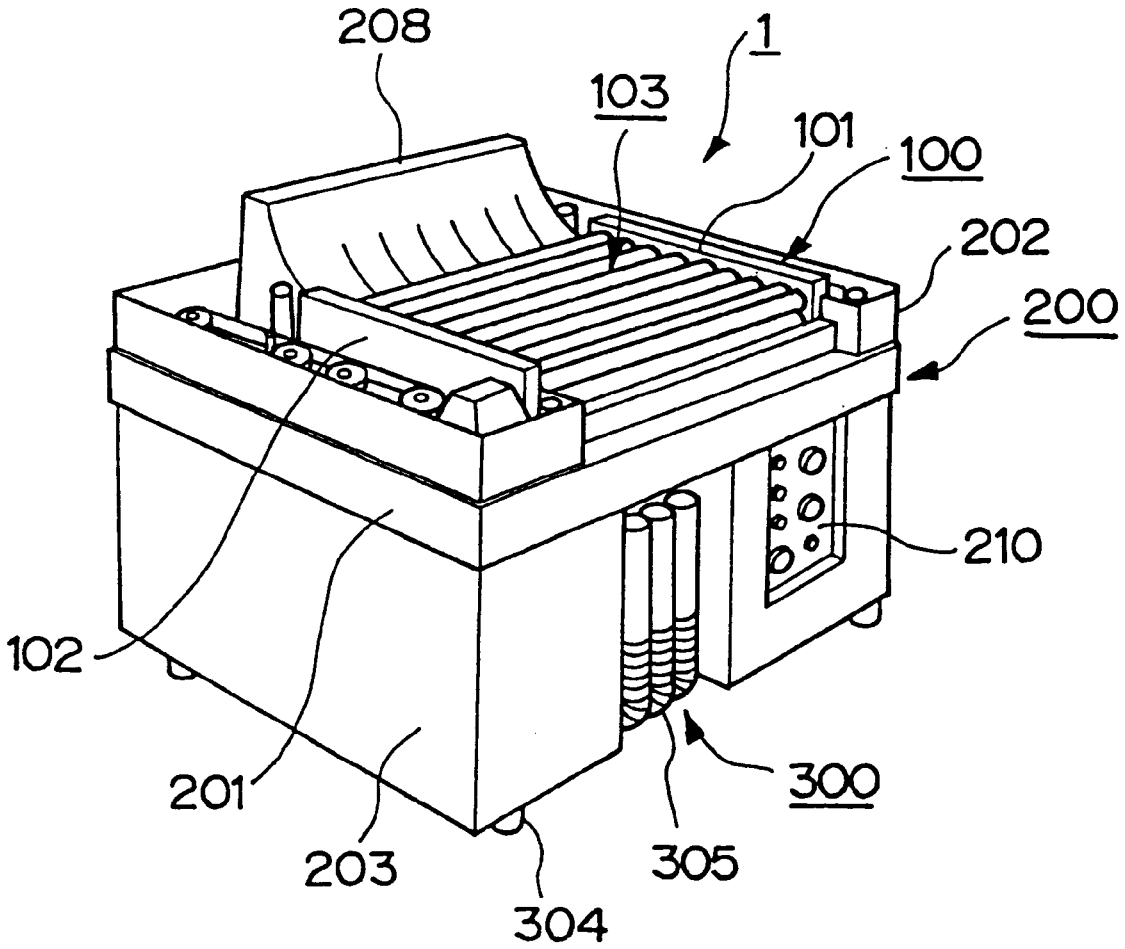
FIG. 2 is a perspective view of the dental X-ray film developing processor in which the base plate block shown in FIG. 1 has been assembled in a chassis block.
Figure 3:
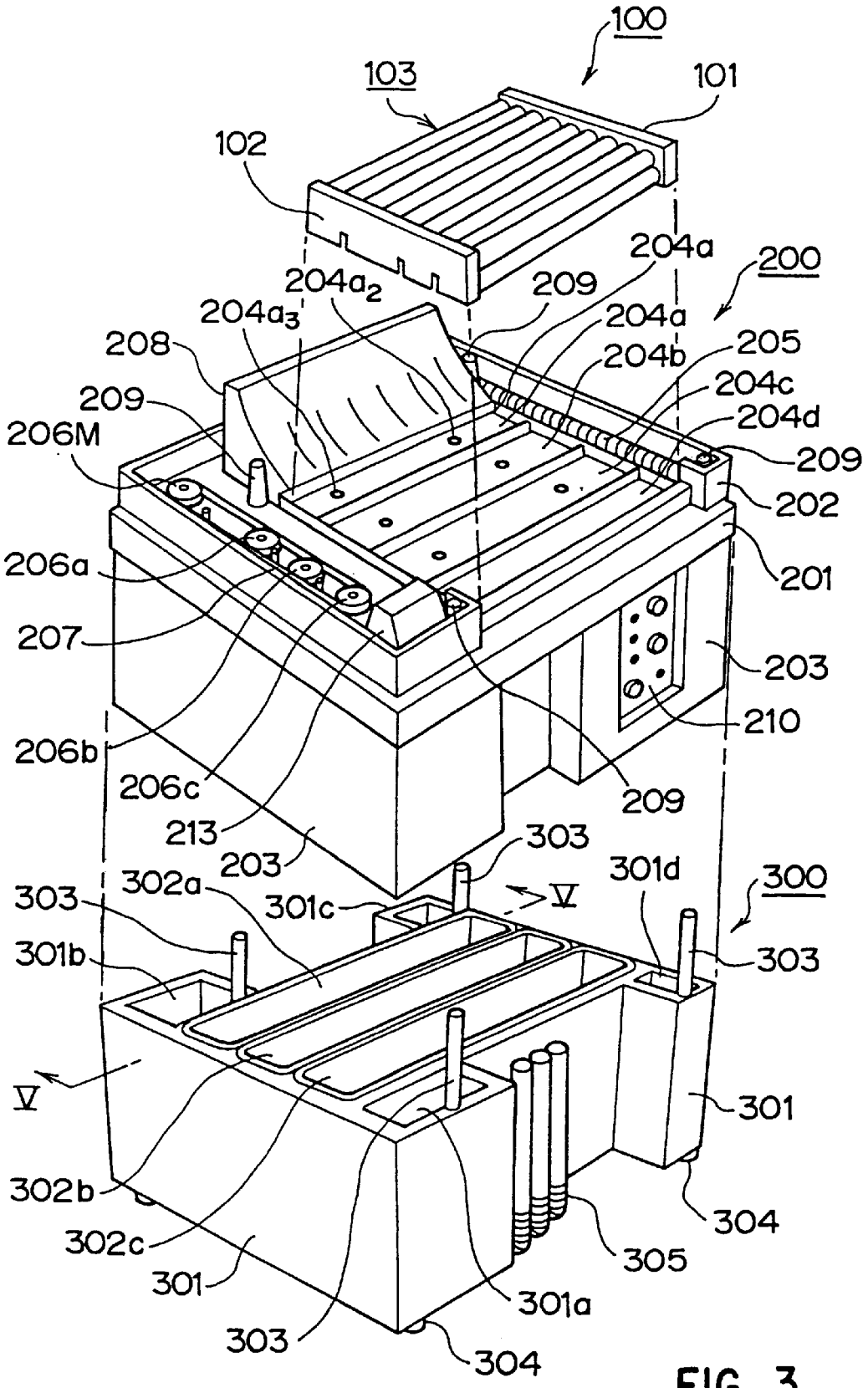
FIG. 3 is an exploded perspective view of the dental X-ray film developing processor depicted in FIG. 2.

FIG. 1 is the perspective view of the lower side of the base plate block of the dental X-ray film developing processor according to the embodiment of the present invention, FIG. 2 is the perspective view of the dental X-ray film developing processor in which the base plate block shown in FIG. 1 has been assembled in the chassis block, and FIG. 3 is the exploded perspective view of the dental X-ray film developing processor depicted in FIG. 2. In this embodiment, the dental X-ray film developing processor shown at numeral 1 in FIG. 2 is composed of three blocks, that is, a roller block 100, the base plate block 200 also depicted in FIG. 1, and the chassis block designated at numeral 300. The constructions of the roller block 100 and the chassis block 300 will be described with reference to FIG. 3, and the construction of the base plate block 200 will be described with reference to FIGS. 1 and 3.

Referring to FIG. 3, the roller block 100 is constructed of side walls 101,102, which are opposing each other, and a roller unit 103 composed of a number of rollers mounted between the side walls 101,102. The roller unit 103 is composed of two roller pairs making up a developing space, two roller pairs forming a fixing space, two roller pairs defining a washing processing space, and two roller pairs constituting a drying space. These rollers are individually provided with rotation-transmitting gears, which are positioned on an outer side of the side wall 101. In this drawing, all the gears are hidden behind the side wall 101 and are not visible.

Referring next to FIG. 3, a description will next be made of the construction of the upper side of the base plate block. There are shown a base plate 201, a frame 202 arranged on the base plate 201, and an exterior panel 203 extending downwardly from the base plate 201. Also illustrated are a developing roller space 204*a*, a fixing roller space 204*b*, a washing roller space 204*c*, and a drying roller space 204*d*. The roller block 100 is inserted in these spaces. The developing roller space 204*a* is constructed in the shape of a box formed of a bottom wall $\mathbf{204}a_1$, and walls which extend upright from four sides of the bottom wall, respectively. The bottom wall $\mathbf{204}a_1$, is provided with a developer return hole $\mathbf{204}a_2$ and a developer feed hole $\mathbf{204}a_3$. In this embodiment, the above-described overflow is not used and, instead, a developer fed into the developing space is returned through the developer return hole $\mathbf{204}a_2$ to a developer reservoir to be described subsequently herein. The constructions of the fixing roller space 204*b* and washing roller space 204*c* are similar to that of the developing roller space 204*a*.

The drawing also illustrates a worm shaft 205 maintained in meshing engagement with gears of individual lower rollers of the roller pairs to rotate the lower rollers, a pump motor pulley 206M connected directly with a below-described pump motor and rotated by the pump motor, pump pulleys 206*a*,206*b*,206*c* for rotating a developer pump, a fixer pump and a washing solution pump, respectively, and a belt 207 connecting the individual pump pulleys 206*a*, 206*b*,206*c* to the pump motor pulley 206M. Designated at numeral 208 is a chute for immersing each exposed X-ray film, while numeral 209 indicates assembling hollow guide studs arranged upright in four corners on the upper side of the base plate 201. Numeral 213 indicates a warm-air fan for blowing warm air into the drying roller space 204*d* to dry each X-ray film.

The construction of the lower side of the base plate block 200 is illustrated in FIG. 1. Elements in FIG. 1, which are the same as the corresponding ones shown in FIG. 3, are identified by like reference signs, and their description is omitted herein. Incidentally, this figure is illustrated with the exterior panel 203 removed, and the contour of the exterior panel 203 is indicated by a phantom there. Numeral 210 indicates a control box in which switches and the like for the operation of the dental X-ray film developing processor are arranged. The control box is exposed at a surface thereof through an opening of the exterior panel 203 as depicted in FIG. 2 and FIG. 3. Also illustrated are a drive motor 211 for rotating the worm shaft 205, a drive pulley 212 connected with the drive motor 211 and also connected with a worm wheel fixed on the worm shaft 205, and the warm-air fan 213. Designated at numeral 214 is the pump motor, which drives the developer pump 215*a*, the fixer pump 215*b* and the washing solution pump 215*c*. To the washing solution pump 215*c*, a lift pipe 216*c* and a feed pipe 217*c* are connected. Lift pipes and feed pipes are also connected to the above-described developer pump 215*a* and fixer pump 205*b*, although their designation by reference signs is omitted.

Designated at sign 218*a* is a float switch to be inserted into the below-described developer reservoir, and the float switch is used for the detection of a solution level in the developer reservoir. A reference sign for a float switch of the fixer reservoir is omitted. The developing processor is equipped with a function which cuts off a power supply circuit if any one of the float switches fails to detect a predetermined solution level, thereby preventing a user from operating the developing processor without filling the reservoirs with the corresponding processing solutions. Also illustrated are a heater 219*a* for the developer reservoir, a heater holder 220*a*, and a heater 219*b* for the fixer reservoir. Reference sign for a heater holder of the heater 219*b* is omitted. Numeral 221 indicates an electric element box, which accommodates various elements of an electric circuit and is integrally formed with a synthetic resin or the like. There are also shown a bottom wall 204$b_1$ of the fixing roller space 204*b* and a fixer return hole 204$b_2$.

With reference to FIG. 3, the construction of the chassis block 300 will be described next. Designated at numeral 301 is a chassis formed as illustrated in the drawing. This chassis supports the weight of the dental X-ray film developing processor. The drawing also shows a receiving space 301*a* for the warm-air fan 213, a receiving space 301*b* for the pump motor 214, a receiving space 301*c* for the drive pulley 212, and a receiving space 301*d* for an exhaust duct. Designated at signs 302*a*, 302*b* and 302*c* are the developer reservoir, the fixer reservoir and the washing solution reservoir. These reservoirs are hold the developer, the fixer and the washing solution, respectively, and are supported by the chassis 301. Designated at numeral 303 are assembling guide pins, which are brought into engagement with the respective assembling hollow guide studs of the base plate block when the base plate block 200 is mounted on the chassis block 300. Numeral 304 indicates four casters for installing the dental X-ray film developing processor on a floor. Designated at numeral 305 are drain hoses for discharging the developer, the fixer and the washing solution from the corresponding reservoirs 302*a*,302*b*,302*c* to the outside.

Figure 4:
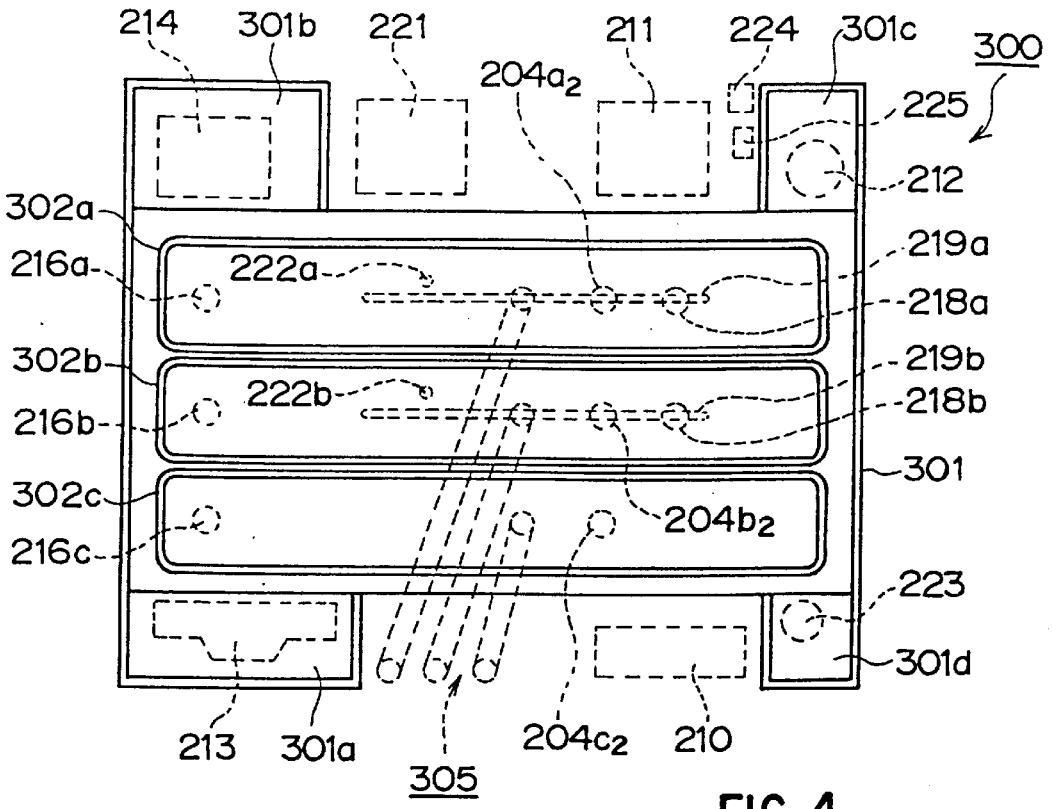
FIG. 4 is a plan view of the chassis block with the base plate block assembled therein as illustrated in FIG. 2.
Figure 5:
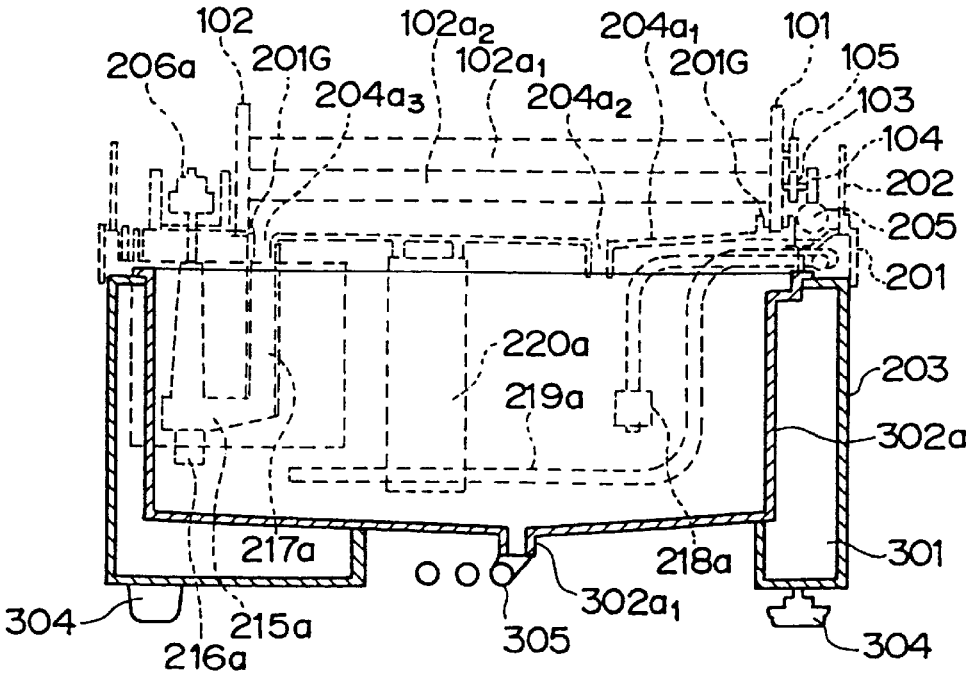
FIG. 5 is a cross-sectional view taken along a line V—V shown in FIG. 3.

Relative positions of the various elements is shown in FIG. 4 and FIG. 5. FIG. 4 is the plan view of the chassis block 300. In this drawing, elements, which are the same as the corresponding ones shown in FIG. 1 and FIG. 3, are identified by like reference signs, and their description is omitted herein. The elements indicated by dashed lines are those making up the base plate block 200, and show their relative positions in the state that the base plate block 200 has been mounted on the chassis block 300. Signs 216*a*, 216*b*,216*c* indicate lift pipes for the developer pump, fixer pump and washing solution pump 215*a*,215*b*,215*c*, respectively, and signs 218*a*,218*b* designate the float switches mentioned above. The heaters 219*a*,219*b* are positioned substantially at centers in the developer reservoir 302*a* and the fixer reservoir 302*b*, respectively. Designated at signs 204$a_2$,204$b_2$,204$c_2$ are the above-mentioned return holes formed in communication with the respective roller spaces. Also illustrated are solution temperature sensors 222*a*,222*b*, which detect the temperatures of the developer and fixer, respectively, and output electrical signals corresponding to the temperatures. These solution temperature sensors are arranged in the base plate block 200 although they appear neither in FIG. 1 nor in FIG. 3. The temperatures of the individual processing solutions are maintained at their corresponding, predetermined temperatures by the above-described corresponding heaters and solution temperature sensors. Numeral 223 indicates the exhaust duct inserted in the space 301*d*, which performs exhaustion of warm air produced by the warm-air fan 213 and used to dry the X-ray film in the space formed between the drying roller pairs. An earth leakage breaker 224 is fixed on the base plate block 200 and, when an electric leakage is detected, cuts off the power supply circuit. Designated at numeral 225 is a limiter switch fixed on the base plate block 200, and this limiter switch has a function to close the power supply circuit when the roller block 100 has been mounted on the base plate block 200. The earth leakage breaker is to avoid any danger which may arise if a solution leakage takes place at any place for one or another cause. On the other hand, the limiter switch serves to prevent the processing solutions from overflowing out of the roller spaces should the user operate the developing processor without mounting the roller block 100.

FIG. 5 is the cross-sectional view taken along the line V—V shown in FIG. 3. This drawing shows relative positions of the individual elements in the state that the base plate block 200 has been mounted on the chassis block 300 and the roller block 100 has been mounted on the base plate block 200. In this drawing, elements which are the same as the corresponding elements shown in FIG. 1, FIG. 3 and FIG. 4 are designated by like signs, and their description is omitted herein. Incidentally, the parts of the roller block 100 and base plate block 200 are indicated by dashed lines. The drawing illustrates an upper roller 102$a_1$, and a lower roller 102$a_2$ of one of the roller pairs arranged in the developing roller space, a gear 103 connected with the lower roller

102$a_2$, a worm gear 104 connected with the lower roller 102$a_2$ and maintained in meshing engagement with the worm shaft 205, and a gear 105 connected with the upper roller 102$a_1$, and maintained in meshing engagement with the gear 103. Designated at sign 201G are roller-block-mounting slots. Upon mounting the roller block 100 on the base plate block 200, the side walls 101,102 of the roller block 100 are inserted into the corresponding roller-block-mounting slots 201G.

Figure 6:
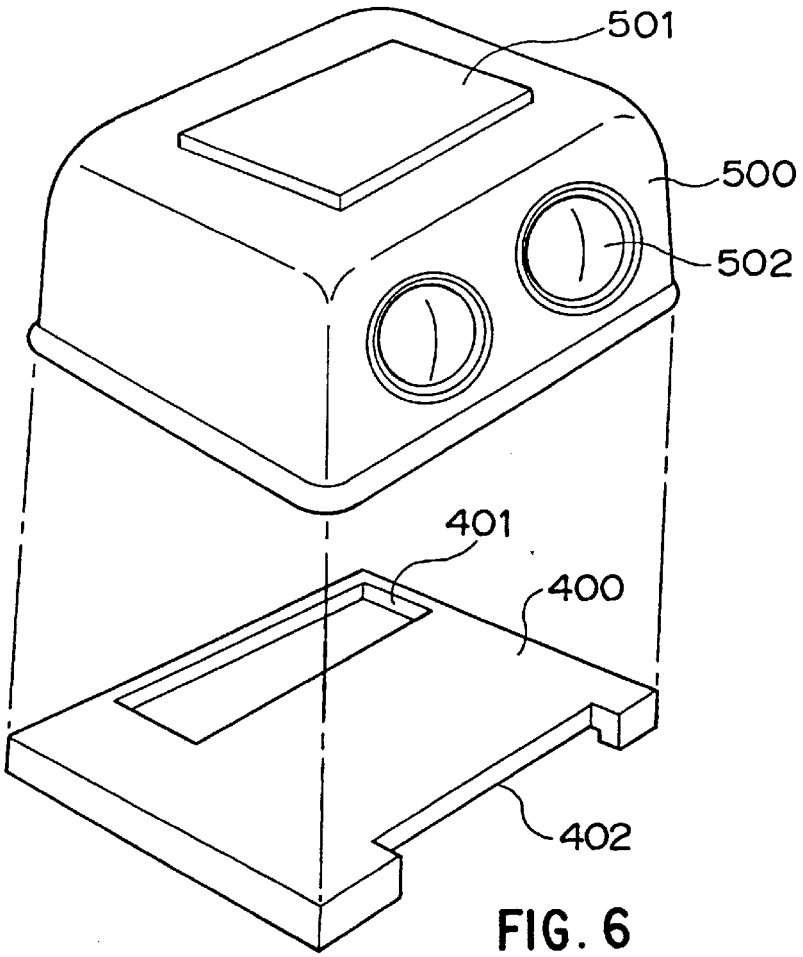
FIG. 6 is a perspective view of a cover and a black box of the dental X-ray film developing processor.

FIG. 6 is the perspective view of the cover and black box of the dental X-ray film developing processor. This drawing shows the cover 400 extending over a top wall of the dental X-ray film developing processor shown in FIG. 1, an opening 401 for allowing the chute 208 to extend out therethrough, and a film outlet slit 402 through which each processed X-ray film comes out. Also shown are the black box 500 arranged over the cover 400 and an inlet/outlet cover 501 closing an inlet/outlet opening through which each X-ray film can be taken in and out. Numeral 502 indicates hand insertion openings which allow the operator of the developing processor to insert both hands into the black box while maintaining the black box in a light-shielded state. Inside the black box 500, each X-ray film is taken out of its pack and is then placed on the chute 208. Subsequent to completion of the development, the X-ray film comes out through the film outlet slit 402.

Figure 7:
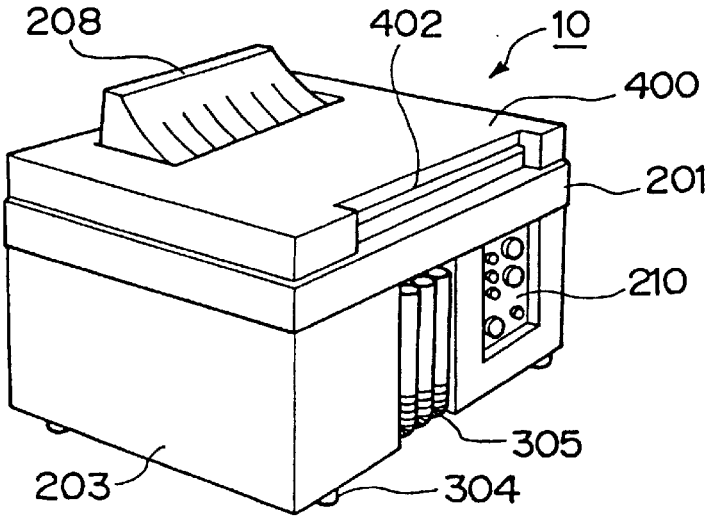
FIG. 7 is a perspective view of the dental X-ray film developing processor in a fully assembled form.

FIG. 7 is the perspective view of the dental X-ray film developing processor in the fully assembled form. Numeral 10 indicates the fully-assembled dental X-ray film developing processor. Actually, the black box 500 is also mounted. However, the black box 500 is omitted in the drawing to clearly show the position of the chute 208. In FIG. 7, elements, which are the same as the corresponding elements in FIG. 2 and FIG. 6, are indicated by like reference numerals. The dental X-ray film developing processor 10 is the same as the dental X-ray film developing processor 1 shown in FIG. 2 except that its top wall is covered by the cover 400 depicted in FIG. 6.

A discussion will now be made about troubles of the individual rollers in the roller block 100 and of the individual reservoirs in the chassis block. The above-described rollers and their gears are relatively free from troubles except for troubles caused by wearing through the use over an extended period of time and likewise, the individual reservoirs are substantially free of troubles except for deteriorations of their material. In this embodiment, the parts other than the above-described rollers and reservoirs are all put together in the base plate block 200 to cope with any trouble the occurrence of which is likely or not very likely.

According to this embodiment, the dental X-ray film developing processor is constructed of the roller block 100, the base plate block 200, the chassis block 300, the cover 400 and the black box 500, and the parts each of which is considered to involve a potential problem of developing a trouble are all arranged in the base plate block 200. In the event of occurrence of a trouble, the user can promptly cope with any trouble, no matter how far the user's place is, if the seller or manufacturer sends a perfect base plate block 200 in a container to the user of the broken developing processor and the user removes the broken base plate block 200 from the developing processor and install the thus-received perfect base plate block 200 instead. It is therefore possible to significantly shorten the period during which the dental X-ray film developing processor cannot be used, thereby lessening inconvenience in dental treatments and diagnoses.

It is necessary for the user to send back to the seller or manufacturer the broken base plate block 200 in the same container as that received with the perfect base plate block 200 in it. The seller or manufacturer repairs the trouble of the thus-received base plate block 200 and sends it back to the user in the same container. It is then necessary for the user to put back the thus-received, repaired base plate block 200 and sends the removed base plate block back to the seller or manufacturer in the same container. The labor and time which are required for the above shipments can be substantially reduced provided that the container is produced beforehand in conformity with the configuration of the base plate block 200.

According to this embodiment, servicemen are no longer required. Even if such servicemen have to be transferred to a repair section, it is unnecessary to transfer all the servicemen to the repair section, because repair work under this embodiment can eliminate the time heretofore required for each serviceman to go to and come back from each broken developing processor, the labor hitherto required for each serviceman to carry one or more parts with him and also the time previously required for each serviceman's second roundtrip when he carried a wrong part with him and, moreover, repair work under this embodiment can be finished in shorter time compared with repairs by the conventional servicemen in view of the possibility that the repair work can be quickly conducted since the repair work is performed at the in-house repair section and the parts and the tools and equipments required for the repair work are thus all available for immediate use. As a consequence, the seller or manufacturer can substantially reduce the number of its staff.

In the above description of the embodiment, the dental X-ray film developing processor which was able to perform all the processings, i.e., development, fixing, washing and drying was explained by way of example. It is however apparent that the present invention is also applicable to such a dental X-ray film developing processor as performing only development and fixing and requiring to practice washing and drying in a another processor or to such a dental X-ray film developing processor as performing development, fixing and washing and requiring to conduct drying in another processor.

Further, the description was made about the embodiment equipped with the heaters, the solution temperature sensors, the float switches, the earth leakage breaker and the limiter switch. However, the heaters and the liquid temperature sensors are not absolutely needed for developing processors which are used in warm areas. In addition, the earth leakage breaker, the float switches and the limiter switch become unnecessary provided that the user operates the developing processor as described in instruction manuals. Even if a trouble occurs due to the elimination of such parts, it is only necessary to send the base plate block to the seller or manufacturer. The provision of such parts is therefore not essential.

As has been described above, the dental X-ray film developing processor according to the present invention is constructed of the roller block, the base plate block and the chassis block, and the parts each of which involves a potential problem of developing a trouble are all arranged in the base plate block. In the event of occurrence of a trouble, the trouble can be promptly coped with, irrespective of the nature of the trouble and no matter how remote the place of the user of the broken developing processor is, if the seller or manufacturer sends a perfect base plate block in a container to the user and the user, on the other hand, remove the base plate block form the developing processor and replace it with the thus-received perfect base plate unit. This makes it possible to significantly shorten the period during which the dental X-ray film developing processor is not usable, and hence to lessen inconvenience in dental treatments and diagnoses.

Moreover, the seller or manufacturer no longer requires servicemen and can substantially reduce the number of staff by transferring them to a repair section.

I claim:

1. A dental X-ray film developing processor provided with at least two sets of roller pairs, each set including two roller pairs arranged at an interval therebetween and composed individually of mutually-contacting two rollers disposed in an up-and-down relationship, thereby permitting development of a dental X-ray film between said roller pairs in a first set and fixing of said dental X-ray film between said roller pairs in a second set, comprising: an integrally-constructed roller block with said individual rollers assembled therein; an integrally-constructed base plate block having a base plate, two roller spaces continuously formed on an upper side of said base plate and accommodating said rollers therein to construct a developer filling space and a fixer filling space in combination with said rollers, a roller drive mechanism for driving said individual rollers, processing solution filling devices for filling corresponding processing solutions from a developer reservoir and a fixer reservoir into said developer filling space and said fixer filling space, a control box provided with operation devices for said developing processor, and an electric element assembly collectively storing therein electric elements of a drive circuit for said dental X-ray film developing processor, said roller drive mechanism, said processing solution filling devices, said control box and said electric element assembly being all fixed on a lower side of said base plate; and a chassis block with at least said developer reservoir and said fixer reservoir assembled therein; whereby said roller block, said base plate block and said chassis block are detachable independently.

2. A dental X-ray film developing processor according to claim 1, wherein said base plate block has heaters and solution temperature sensors fixed thereon so that said heaters and said solution temperature sensors can be positioned in said developer reservoir and said fixer reservoir, respectively.

3. A dental X-ray film developing processor according to claim 2, wherein said base plate block has at least one of float switches positioned in said developer reservoir and said fixer reservoir to detect solution levels therein, an earth leakage breaker for cutting off a power supply upon detection of an electric leakage, and a limiter switch for closing a power supply circuit when said roller block has been mounted on said base plate block.

4. A dental X-ray film developing processor according to claim 3, wherein said roller drive mechanism comprises a drive motor and a rotation transmitting mechanism for transmitting rotation of said drive motor to said individual rollers.

5. A dental X-ray film developing processor according to claim 3, wherein said processing solution filling devices comprise a pump motor, pumps for said respective processing solutions, said pumps being drivable by said pump motor, and pipings connecting said pumps and said processing solution filling spaces, respecatively.

6. A dental X-ray film developing processor according to claim 2, wherein said roller drive mechanism comprises a drive motor and a rotation transmitting mechanism for transmitting rotation of said drive motor to said individual rollers.

7. A dental X-ray film developing processor according to claim 2, wherein said processing solution filling devices comprise a pump motor, pumps for said respective processing solutions, said pumps being drivable by said pump motor, and pipings connecting said pumps and said processing solution filling spaces, respectively.

8. A dental X-ray film developing processor according to claim 1, wherein said base plate block has at least one of float switches positioned in said developer reservoir and said fixer reservoir to detect solution levels therein, an earth leakage breaker for cutting off a power supply upon detection of an electric leakage, and a limiter switch for closing a power supply circuit when said roller block has been mounted on said base plate block.

9. A dental X-ray film developing processor according to claim 8, wherein said roller drive mechanism comprises a drive motor and a rotation transmitting mechanism for transmitting rotation of said drive motor to said individual rollers.

10. A dental X-ray film developing processor according to claim 8, wherein said processing solution filling devices comprise a pump motor, pumps for said respective processing solutions, said pumps being drivable by said pump motor, and pipings connecting said pumps and said processing solution filling spaces, respectively.

11. A dental X-ray film developing processor according to claim 1, wherein said roller drive mechanism comprises a drive motor and a rotation transmitting mechanism for transmitting rotation of said drive motor to said individual rollers.

12. A dental X-ray film developing processor according to claim 1, wherein said processing solution filling devices comprise a pump motor, pumps for said respective processing solutions, said pumps being drivable by said pump motor, and pipings connecting said pumps and said processing solution filling spaces, respectively.

13. A dental X-ray film developing processor provided with four sets of roller pairs, each set including two roller pairs arranged at an interval there-between and composed individually of mutually-contacting two rollers disposed in an up-and-down relationship, thereby permitting development of a dental X-ray film between said roller pairs in a first set, fixing of said dental X-ray film between said roller pairs in a second set, washing of said dental X-ray film between said roller pairs in a third set and drying of said dental X-ray film between said roller pairs in a fourth set, comprising: an integrally-constructed roller block with said individual rollers assembled therein; an integrally-constructed base plate block having a base plate, four roller spaces continuously formed on an upper side of said base plate and accommodating said rollers therein to construct a developer filling space, a fixer filling space, a washing solution filling space and a drying space in combination with said rollers, a roller drive mechanism for driving said individual rollers, processing solution filling devices for filling corresponding processing solutions from a developer reservoir, a fixer reservoir and a washing solution reservoir into said developer filling space, said fixer filling space and said washing solution filling space, a control box provided with operation devices for said developing processor, and an electric element assembly collectively storing therein electric elements of a drive circuit for said dental X-ray film developing processor, heaters, solution temperature sensors and solution-level-detecting float switches positioned in said developer reservoir and said fixer reservoir, an earth leakage breaker for cutting off a power supply upon detection of an electric leakage, a limiter switch for closing a power supply circuit when said roller block has been mounted on said base plate block, and a warm-air fan for blowing warm air into said drying space, said roller drive mechanism, said processing solution filling devices, said control box, said electric element assembly, said heaters, said solution temperature sensors, said float switches, said earth leakage breaker, said limiter switch and said warm-air fan being all fixed on a lower side of said base plate; and a chassis block with said developer reservoir, said fixer reservoir and said washing solution reservoir assembled therein; whereby said roller block, said base plate block and said chassis block are detachable independently.

14. A dental X-ray film developing processor according to claim 13, wherein said roller drive mechanism comprises a drive motor and a rotation transmitting mechanism for transmitting rotation of said drive motor to said individual rollers.

15. A dental X-ray film developing processor according to claim 13, wherein said processing solution filling devices comprise a pump motor, pumps for said respective processing solutions, said pumps being drivable by said pump motor, and pipings connecting said pumps and said processing solution filling spaces, respectively.

16. A dental X-ray film developing processor, wherein components, each of which is considered to involve a potential problem of developing trouble, are all assembled in a single block, and said block is mounted detachably relative to an entirety of said processor.

17. A dental X-ray film developing processor comprising a roller block composed of plural rollers for permitting development of a dental X-ray film, a base plate block, and a chassis block with a built-in reservoir containing a processing solution for said development, said base plate block being provided at least with a roller drive mechanism for driving said rollers and a processing solution feeding device for feeding said processing solution from said reservoir to said roller block, whereby said roller block, said base plate block and said chassis block are detachable independently.

* * * * *